US005147262A

United States Patent [19]

Hymanson

[11] Patent Number: 5,147,262

[45] Date of Patent: Sep. 15, 1992

[54] ISOKINETIC OSCILLATING EXERCISE APPARATUS

[76] Inventor: Bruce Hymanson, P.O. Box 5100, Playa del Rey, Calif. 900256

[21] Appl. No.: 845,745

[22] Filed: Mar. 2, 1992

Related U.S. Application Data

[63] Continuation of Ser. No. 546,542, Jun. 29, 1990, abandoned, which is a continuation of Ser. No. 263,820, Oct. 28, 1988, Pat. No. 4,964,633.

[51] Int. Cl.[5] ..... A63B 21/002

[52] U.S. Cl. ..... 482/110; 482/121; 482/148; 482/908

[58] Field of Search ..... 482/18, 38, 41, 44–80, 482/91, 92, 106, 108, 110, 121, 122, 131, 139, 148, 908; 446/486; 273/1 G, 1 GE; 33/403, 479, 485, 486, 493

[56] References Cited

U.S. PATENT DOCUMENTS

| | | | |
|---|---|---|---|
| 1,102,771 | 7/1914 | Loughlin | 33/493 |
| 2,307,892 | 1/1943 | Lowther | 33/485 X |
| 2,396,106 | 3/1946 | Kusznir | 272/67 |
| 3,342,482 | 9/1967 | Padlone | 482/110 |
| 3,398,447 | 8/1968 | Dolgorukov | 33/493 X |
| 3,756,597 | 9/1973 | Mooti | 482/110 X |
| 3,820,781 | 6/1974 | Kane | 272/117 X |
| 3,843,117 | 10/1974 | Johnson | 482/110 |
| 3,884,464 | 5/1975 | Evangelos | 272/135 |
| 4,017,070 | 4/1977 | Hilton | 272/104 |
| 4,040,620 | 8/1977 | Friedman | 272/137 |
| 4,060,902 | 12/1977 | Keller | 33/403 |
| 4,257,591 | 3/1981 | Evans, Sr. | 272/125 |
| 4,306,479 | 12/1981 | Eberhardt | 33/479 X |
| 4,355,472 | 10/1982 | Wedge | 33/486 |
| 4,428,577 | 1/1984 | Weinhardt | 272/135 |
| 4,632,392 | 12/1986 | Petton et al. | 482/110 |
| 4,863,159 | 9/1989 | Brown, Jr. | 272/135 |
| 4,964,633 | 10/1990 | Hymanson | 272/125 |

FOREIGN PATENT DOCUMENTS

| | | | |
|---|---|---|---|
| 1195209 | 6/1965 | Fed. Rep. of Germany | 272/135 |

OTHER PUBLICATIONS

Vierck, R., Vibration Analysis. N. T., Harper Add Row, 1979, pp. 148–177.

*Primary Examiner*—Robert Bahr

*Attorney, Agent, or Firm*—Poms, Smith, Lande & Rose

[57] ABSTRACT

An isokinetic oscillating exercise apparatus which may be used to exercise different muscles by grasping by one hand or two hands centrally-located gripping portions attached to an elongated member and moving or shaking the member back and forth causing the opposite ends of the member to oscillate. The oscillation causes isokinetic exercising of a user's muscles. The gripping portions may be attached to the elongated member by adhesive or screws threaded into sleeves. Telescoping ends may be used to vary the length of the elongated member or the oscillating range of the member. The telescoping ends may be used to significantly reduce the overall length of the elongated member for ease in carrying the apparatus or for storage purposes. The telescoping ends may be small pipes which fit inside a large pipe, or flat elongated strips of metal that slidably engage brackets attached to a flat elongated member.

3 Claims, 3 Drawing Sheets

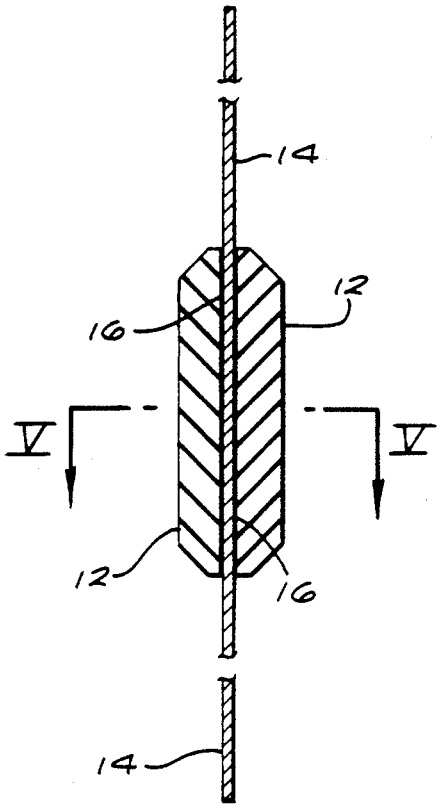
FIG. 4
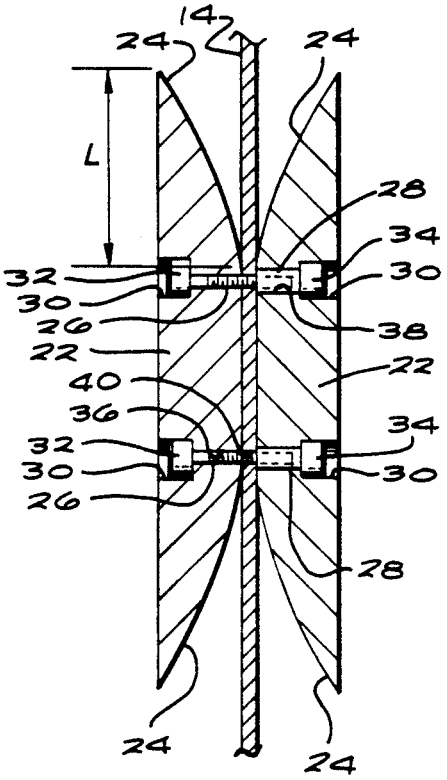
FIG. 6
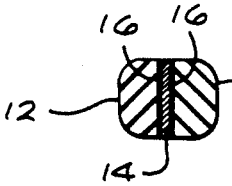
FIG. 5
FIG. 7
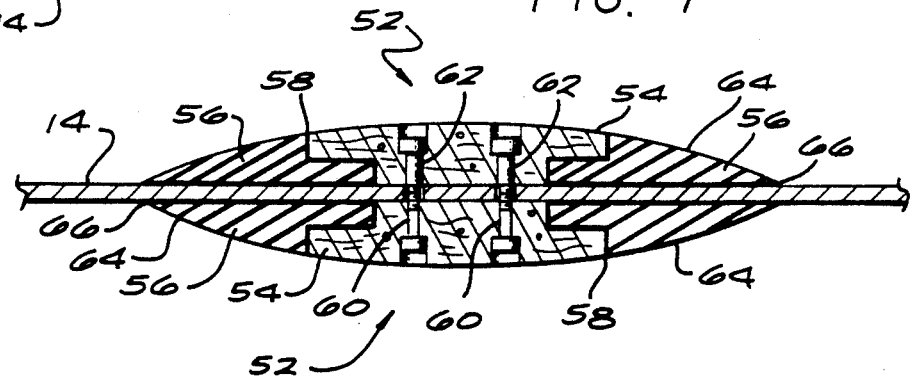

FIG. 8
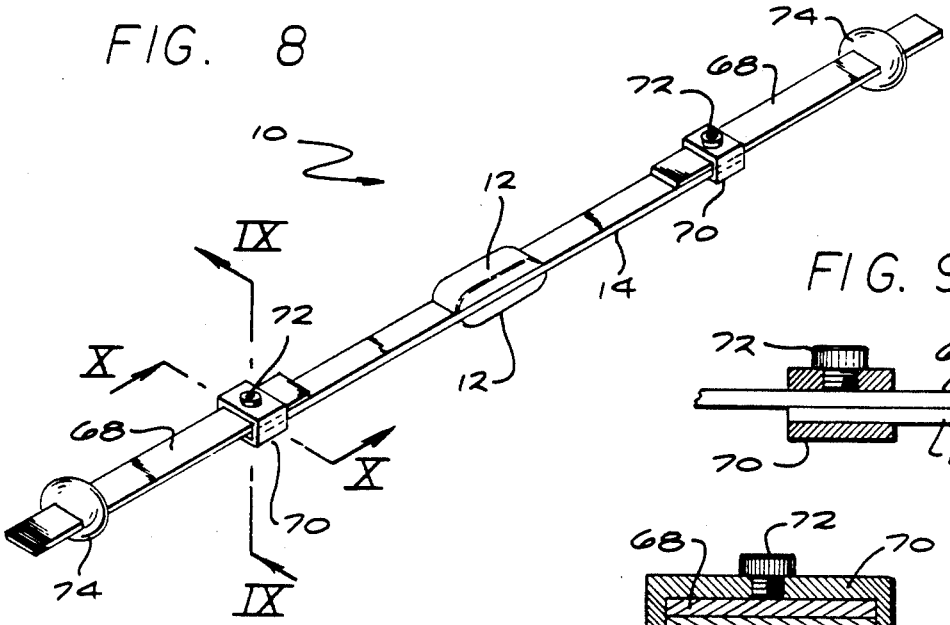
FIG. 9
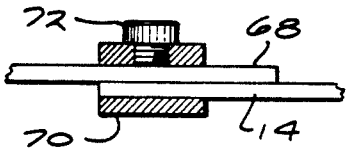
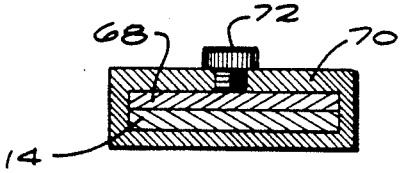
FIG. 10
FIG. 11
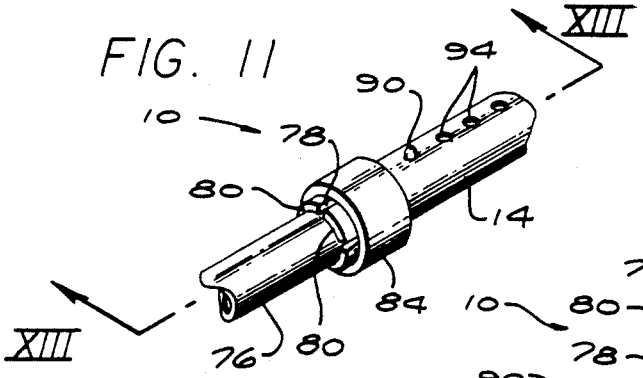
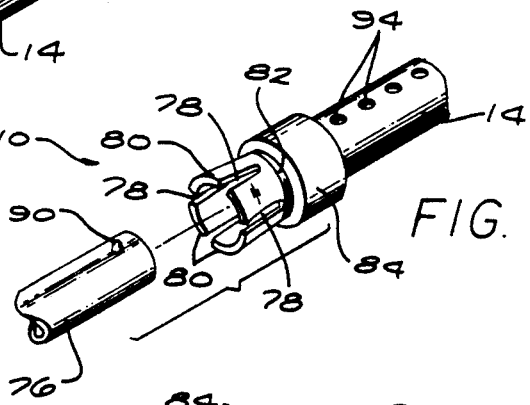
FIG. 12
FIG. 13
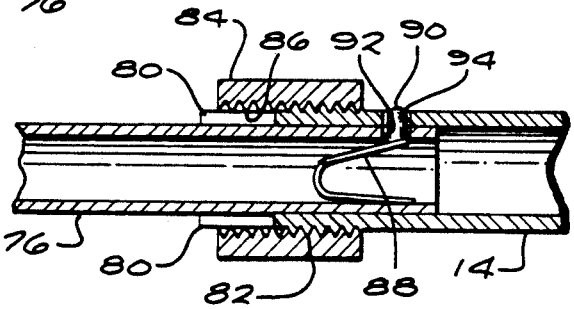

ISOKINETIC OSCILLATING EXERCISE APPARATUS

This is a continuation Ser. No. 07/546,542, filed on Jun. 29, 1990, now abandoned, which is a continuation of Ser. No. 07/263,820, filed Oct. 28, 1988, now U.S. Pat. No. 4,964,633.

BACKGROUND OF THE INVENTION

The present invention relates generally to exercise apparatus and, more particularly, to an isokinetic oscillating exercise apparatus which may be used to exercise different muscles by grasping by one hand or two hands centrally-located gripping portions attached to an elongated member and moving or shaking the member back and forth, causing the opposite ends of the member to oscillate.

Various exercise apparatus have been used in the past which a person may grasp by his or her hand and lift for the purpose of exercising particular arm muscles or other muscles of the body. For example, dumbbells are disclosed in U.S. Pat. Nos. 1,918,142, issued to Smith on Jul. 11, 1933; 1,013,782, issued to Koch on Jan. 2, 1912; and 460,270, issued to Somerby on Sep. 29, 1891. However, such dumbbells are used to exercise only isolated muscle groups, one group at a time, on only one side of a person's arm, depending on which direction the dumbbells are moved or lifted. As a result, muscle groups at opposite sides of a person's arm are not exercised simultaneously or at the same time by movement of the dumbbells.

An exercising device is described in U.S. Pat. No. 4,268,031, issued to Schomburg on May 19, 1981. The device has a hoop with a ball held at the center of the hoop by tensioned, radially-disposed elastic strings or lines. A user grasps the ball and moves it up and down, causing the hoop to oscillate up and down. However, the exercise benefits of this device are limited due to the flexibility of the elastic strings.

Another device providing minimal exercise benefits is shown in U.S. Pat. No. 3,545,121, issued to Micks on Dec. 8, 1970. This device has a sphere trapped between two springs on a shaft. A person is able to hold one end of the shaft and cause the sphere to slide up or down the shaft rebounding between the springs in response to hand and wrist movements. Still another device providing limited, if any, exercise benefits is disclosed in U.S. Pat. No. 4,305,582, issued to Barton on Dec. 15, 1981. This device is intended for use as an amusement device. Cylindrically-shaped sections held together by an elastic cord passing through longitudinal bores in the sections form a segmented elongated device. A user may shake, move or tip the device causing the sections to move relative to one another, and the ends of the device to oscillate. However, the sections of this device oscillate in a random unpredictable fashion making it difficult to use as an exercise device. Also, the elastic cord holding the sections together provides a weak design (may break), preventing steady and rapid oscillation of the sections.

U.S. Pat. No. 3,425,690, issued to Charbonnet on Feb. 4, 1969, describes a hoop held to a belt by elastic members such as ropes. The belt may be attached to the waist or head of a user, allowing the user to move the hoop vertically or cumferentially about the body due to corresponding movement of the user's body. This device cannot be used to simultaneously exercise muscles on both sides of a person's arm. Finally, an exercising device having a number of elongated rubber tubes passing through a rubber sleeve is disclosed in U.S. Pat. No. 1,254,974, issued to Briggs on Jan. 29, 1918. The sleeve functions like a handle and may be grasped and moved back and forth to cause the ends of the tubes to oscillate. Flexible elongated members such as rubber tubes are needed for the device because it is intended to be used to strike the arms, back, shoulders or other parts of a user, or to produce a massaging effect. However, the rubber tubes used for this device are so flexible that the exercise benefits of the device are significantly reduced.

Isokinetic exercise devices have been used in the past. Isokinetic exercise is an accommodating variable resistance in which the speed of motion of a limb to be exercised is set and the resistance accommodates to match the force applied. During this type of exercise, movement of the limb is performed at a constant angular velocity. Once a preset angular velocity is attained, resistance to movement is then determined by the effort of the person exercising. When isokinetic exercise is used, strength and power gains are excellent at faster speeds, and endurance is also developed at faster speeds. In addition, muscles on both sides of a limb are exercised during isokinetic exercise. However, past isokinetic exercise devices have been expensive to manufacture, usually requiring complicated and bulky equipment.

SUMMARY OF THE INVENTION

None of the above patents discloses a simple isokinetic exercise device which may be used for exercising muscle groups such as the muscles of a person's arm that is economical to manufacture and easy to use. A device or apparatus using an elongated member capable of being oscillated can be used for isokinetic exercising. The arm muscles may be exercised by grasping by one hand or two hands centrally-located gripping portions attached to the member and shaking the member back and forth causing opposite ends of the member to oscillate. The oscillating ends and the resistance caused by a person grasping the gripping portions while the ends oscillate cause muscles on opposite sides of a person's arm to reciprocally contract and relax numerous times, resulting in isokinetic exercise of the muscles. Such isokinetic exercise strengthens muscles, increases power and quickness in muscle contractions and relaxations, increases muscle endurance, improves coordination between muscles on opposite sides of a person's arm, balances muscle tone between muscles on opposite sides of the arm, and promotes proximal stability at the upper part of a person's arm for distal mobility or movement of the person's hand. In addition, such an isokinetic oscillating exercise apparatus exercises, for example, other muscles such as forearm muscles when the elongated member is gripped near the middle and shaken back and forth, causing the ends of the member to oscillate.

It is an object of this invention to provide an isokinetic oscillating exercise apparatus which may be used for isokinetic exercising.

It is still another object of this invention to provide an isokinetic oscillating exercise apparatus which may be used to isokinetically exercise muscles on opposite sides of a person's arm.

It is still another object of this invention to provide an isokinetic exercise apparatus that strengthens muscles, increases power and quickness in muscle contractions and relaxations, increases muscle endurance, improves coordination between muscles on opposite sides of a person's arm, balances muscle tone between muscles on opposite sides of the arm, and promotes proximal stability at the upper part of a person's arm for distal mobility or movement of the person's hand.

It is still another object of this invention to provide an isokinetic oscillating exercise apparatus which may be reduced in size for storage or carrying purposes.

It is still another object of this invention to provide an isokinetic oscillating exercise apparatus which is of simple design and economical to manufacture.

These and other objects and advantages are attained by an isokinetic oscillating exercise apparatus which may be used to exercise different muscles by grasping by one hand or two hands centrally-located gripping portions attached to an elongated member and moving or shaking the member back and forth causing opposite ends of the member to oscillate. The oscillation causes isokinetic exercising of a user's muscles. The gripping portions may be attached to the elongated member by adhesive, rivets, screws threaded into sleeves, or the like. The ends of the gripping portions may have curved surfaces which increase the effective lengths of the flexible portions of the elongated member on both sides of the gripping portions that are free to bend or oscillate. In addition, the gripping portions may be made out of wood and rubber portions attached together by adhesive.

Telescoping ends may be used to vary the length of the elongated member, or the oscillating range of the member. The telescoping ends may be used to significantly reduce the overall length of the elongated member for ease in carrying the apparatus or for storage purposes. The telescoping ends may be small pipes which fit inside a large pipe (elongated member), or flat elongated strips of metal that slidably engage brackets attached to a flat elongated member.

The various features of the present invention will be best understood together with further objects and advantages by reference to the following description of the preferred embodiment taken in conjunction with the accompanying drawings.

BRIEF DESCRIPTION OF THE DRAWINGS

FIG. 4 is a cross-sectional view taken in the direction of arrows IV—IV of FIG. 3 showing how the gripping portions are attached to the elongated member by adhesive;

FIG. 5 is a cross-sectional view taken in the direction of arrows V—V of FIG. 4;

FIG. 6 is a cross-sectional view taken similar to FIG. 4 showing another embodiment of the gripping portions with curved surfaces attached to the elongated member by screws threaded into sleeves;

FIG. 7 is a cross-sectional view taken similar to FIG. 4 showing yet another embodiment of the gripping portions made out of wood and rubber portions with the wood portion attached to the elongated member by screws threaded into sleeves and the rubber portions attached to the wood portion and the elongated member by adhesive;

FIG. 8 is a perspective view of another embodiment of the isokinetic oscillating exercise apparatus having telescoping ends which may be used to vary the length of the elongated member by loosening screws threaded into brackets on the elongated member and sliding the telescoping ends to any desirable positions on the member and then tightening the screws in order to secure the ends in place;

FIG. 9 is a cross-sectional view taken in the direction of arrows IX—IX of FIG. 8;

FIG. 10 is a cross-sectional view taken in the direction of arrows X—X of FIG. 8;

FIG. 11 is a partial perspective view of still another embodiment of the isokinetic oscillating exercise apparatus showing another telescoping end comprising a small pipe which slidably engages a large pipe for the purpose of varying the length of the elongated member by screwing a sleeve member toward the gripping portions allowing expandable fingers at the end of the large pipe to expand so that the small pipe may be slid back and forth inside the large pipe to any desirable position and then secured in place by screwing the sleeve member back into place and causing an engaging portion of a securing spring inside the small pipe to engage one of a number of positioning apertures in the large pipe;

FIG. 12 is an exploded perspective view of the isokinetic exercise device of FIG. 11 showing the telescoping end disengaged from the large pipe after the sleeve member has been screwed toward the gripping portions allowing the fingers at the end of the large pipe to expand; and FIG. 13 is a cross-sectional view taken in the direction of arrows XIII—XIII of FIG. 11.

DESCRIPTION OF THE PREFERRED EMBODIMENTS

Figure 1:
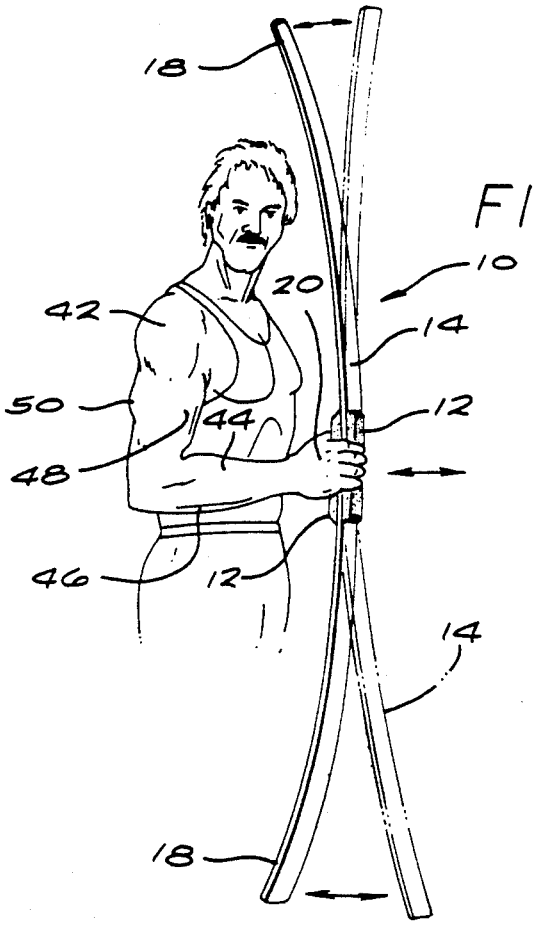
FIG. 1 is a perspective view showing how the isokinetic oscillating exercise apparatus illustrating the principles of the present invention may be grasped at chest level by gripping portions attached to the middle of an elongated member and shook back and forth causing opposite ends of the member to oscillate.
Figure 3:
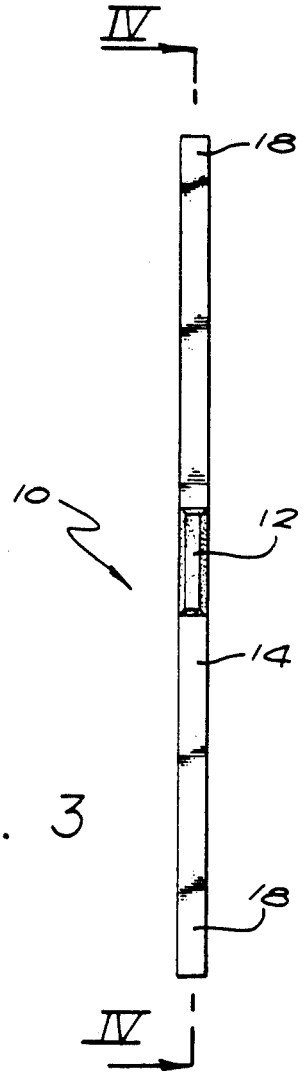
FIG. 3 is an elevation view of the isokinetic oscillating exercise apparatus of FIG. 1.

The following specification taken in conjunction with the drawings sets forth the preferred embodiments of the present invention in such a manner that any person skilled in the art can make or use the invention. The embodiments of the invention disclosed herein are the best modes contemplated by the inventor for carrying out his invention in a commercial environment although it should be understood that various modifications can be accomplished within the parameters of the present invention.

FIGS. 1 through 5 show a preferred embodiment of the isokinetic oscillating exercise apparatus 10 of the present invention. The isokinetic oscillating exercise apparatus 10 has gripping portions 12 attached to the middle of an elongated member 14. Portions 12 are preferably attached to member 14 by an adhesive 16, but any desirable means may be used to attach portions 12 such as nuts, bolts, screws (see FIG. 6), rivets, welds, or the like.

Figure 2:
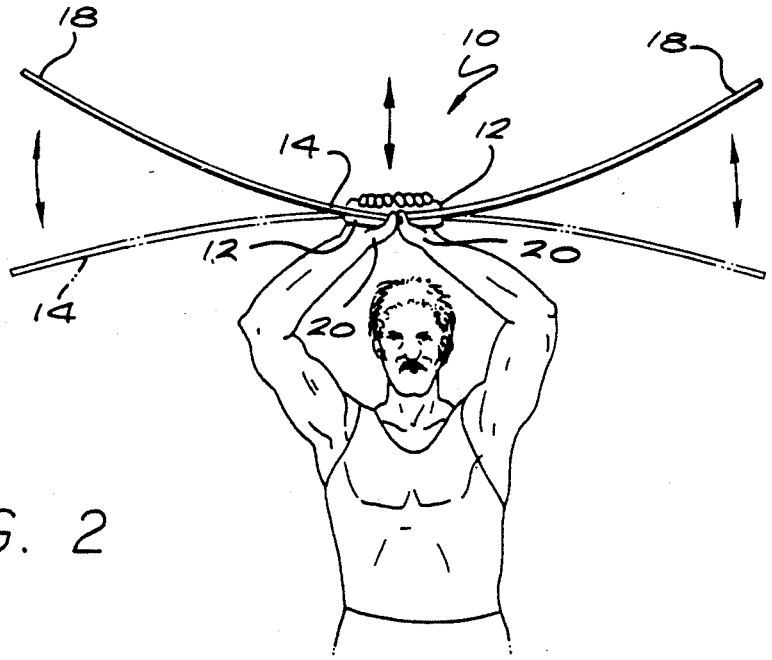
FIG. 2 is a perspective view showing how the isokinetic oscillating exercise apparatus of FIG. 1 may be shaken overhead causing the ends of the elongated member to oscillate.

Elongated member 14 is preferably made out of a flat elongated strip of metal such as aluminum. However, any flexible material such as plastic, wood, graphite, or the like may be used for the elongated member 14 that will bend or flex allowing opposite ends 18 of member 14 to oscillate when portions 12 are grasped by one hand 20 of a user at, for example, chest level and shaken back and forth as illustrated in FIG. 1, or by two hands 20 and shaken back and forth, for example, overhead as illustrated in FIG. 2. The elongated member 14 is preferably made out of aluminum and approximately 5 feet 2 inches long, two inches wide and 7/64 inches thick. If made out of aluminum with these dimensions, the ends 18 of member 14 oscillate in the range of about three to about seven cycles per second when member 14 is shaken for exercising purposes as discussed below.

However, it is important to note that the material and dimensions of the elongated member 14 may be changed to provide any desirable number of cycles per second for isokinetic exercising purposes. For example, member 14 may be hollow, or have a square or circular cross-section, or the like.

Gripping portions 12 shown in FIG. 4 are preferably approximately 8 inches long, 2 inches wide and 1-13/16 inches thick. When portions 12 with these dimensions are made out of rubber and used with the elongated member 14 having the dimensions described above, the ends 18 of member 14 will oscillate in the range of about four to about five cycles per second when shaken for isokinetic exercise purposes as described below. Portions 12 may be made out of any other material such as wood, plastic, or the like. However, the preferable oscillating range for the ends 18 of the elongated member 14 is from about four to about six cycles per second.

FIG. 6 shows another embodiment of the gripping portions 22 with curved surfaces 24 attached to the elongated member 14 by screws 26 threaded into sleeves 28. Portions 22 have countersinks 30 therein for heads 32 and 34 of the screws 26 and sleeves 28, respectively, and bores 36 and 38 for the screws 26 and sleeves 28, respectively. The screws 26 pass through apertures 40 in the elongated member 14. Nuts, bolts, rivets, welds, glue, or the like may be used to attach portions 22 to member 14 if desired. Note that the curved surfaces 24 extend a distance from the ends of the gripping portions 22 to where member 14 comes into contact with (is tangent to) the surfaces 24 as shown in FIG. 6. Curved surfaces 24 increase the effective lengths of the flexible portions of elongated member 14 on both sides of the gripping portions 22, or the distance from the ends of portions 22 to the ends 18 of member 14. As a result, the overall length of elongated member 14 may be reduced if desired when the embodiment of the gripping portions 22 as shown in FIG. 6 is used for the isokinetic oscillating exercise apparatus 10. The ends 18 of the elongated member 14 oscillate in the range of about five to about six when gripping portions 22 about 8 inches long are used with an elongated member 14 about 5 feet 2 inches long.

Another embodiment of the gripping portions 52 is shown in FIG. 7. Each portion 52 has wood and rubber portions 54 and 56, respectively, preferably attached to each other by adhesive 58. The rubber portions 56 are also preferably attached to elongated member 14 by adhesive 58, but may not be so attached if desired. Also, nuts, bolts, rivets, welds, screws, or the like may be used to attach portions 54 and 56 together, or to attach portions 56 to member 14 if desired. Screws 60 and sleeves 62 are preferably used to attach portions 54 to the elongated member 14 as shown in FIG. 7 in a similar manner as screws 26 and sleeves 28 are used to attach portions 22 to member 14 in FIG. 6. Once again, nuts, bolts, rivets, welds, glue or the like may be used instead of screws 60 and sleeves 62 to connect portions 54 to member 14. Portions 56 are flexible and have curved surfaces 64 which result in portions 56 gradually tapering in thickness from a maximum size adjacent where they are attached to portions 54 to a minimum size or pointed edge 66 at their farthest distance from portions 54. Since portions 56 are flexible and tapered, they are able to bend back and forth increasing the effective lengths of the flexible portions of elongated member 14 on both sides of gripping portions 52 when the ends 18 of the elongated member 14 are oscillating. Note that portions 54 may be made out of any other desirable material such as plastic, or the like. Also, flexible portions 56 may be made out of any flexible material other than rubber, such as flexible plastic material, or the like.

The isokinetic oscillating exercise apparatus may be used as follows for isokinetic exercising. Referring again to FIG. 1, the gripping portions 12 may be grasped by one hand 20 at about chest level and used to shake the elongated member 14 back and forth using short and steady strokes, causing the ends 18 of member 14 to oscillate. While ends 18 are oscillating, deltoid muscle 42 at the top of the arm near the shoulder stabilizes the upper portion of the arm while forearm flexor and extensor muscles 44 and 46, respectively, are exercised as portions 12 are gripped and the forearm is stabilized. As oscillation continues, bicep and tricep muscles 48 and 50, respectively, reciprocally contract and relax to balance the forces generated by the oscillating member 14, resulting in isokinetic exercise of these muscles. As such, when the isokinetic oscillating exercise apparatus 10 is used as shown in FIG. 1, muscles on both sides of a person's arm are isokinetically exercised.

FIG. 8 shows another embodiment of the isokinetic oscillating exercise apparatus 10 featuring telescoping ends 68 which may be used to vary the length of the elongated member 14. Ends 68 slidably engage brackets 70 on elongated member 14. Both ends 68 and member 14 are preferably flat elongated strips of metal such as aluminum. The brackets 70 may be attached to member 14 if desired. Screws 72 are threaded into the brackets 70 as shown in FIGS. 9 and 10 so that the screws 72 may be tightened to prevent movement of ends 68 and member 14 relative to each other, or loosened to slide ends 68 inside brackets 70 with respect to member 14. As such, the length of elongated member 14 may be easily varied to any desired length by loosening and tightening screws 12 and sliding telescoping ends 68 back and forth relative to elongated member 14.

By varying the length of the elongated member 14 shown in FIG. 8, the oscillating characteristics of the member 14 may be changed as desired. As a result, the telescoping ends 68 allow a user to vary the oscillating range of the ends 68 and, thus, vary his or her workout by sliding telescoping ends 68 to any desirable positions on elongated member 14. In addition, weights 74 may be removably attached to the telescoping ends 68 as shown in FIG. 8 in order to vary the oscillating range of the elongated member 14 as desired. Any type of weights 74 may be used such as donut-shaped rubber weights 78 which may be easily slipped on and off the ends 68. Even tape wrapped around the telescoping ends 68 may be used as weights 74 for the purpose of changing the oscillating range of the elongated member 14. Note that gripping portions 12 are shown in FIG. 8. However, any other desirable gripping portions may be used such as portions 22 and 52 shown in FIGS. 1 and 7.

Another embodiment of the isokinetic oscillating exercise device 10 is shown in FIGS. 11 through 13 once again featuring telescoping ends 76, or small pipes 76, slidably engaging elongated member 14, or large pipe 14. Note only one of the telescoping ends 76 is shown. However, the exercise device 10 has two similar telescoping ends 76, each slidably engaging one of the ends of elongated member 14 or large pipe 14. In addition, elongated member 14 may have a gripping portion (not shown) at the mid-point thereof. Also, since member 14 is round, it may be grasped directly without the need for a gripping portion, or possibly covered by some fabric, etc. Each end of pipe 14 has slots 78 therein forming expandable fingers 80. As best shown in FIG. 13, pipe 14 has external threads 82 at each end thereof. A sleeve member 84 having internal threads 86 is threaded onto each end of pipe 14 so that threads 86 engage threads 82. When sleeve member 84 is screwed toward the end of pipe 14 by turning said member 84, it causes the expandable fingers 80 to come together and to bear against small pipe 76 helping to prevent pipe 76 from disengaging from large pipe 14. Conversely, when sleeve member 84 is screwed toward the middle of pipe 14 or away from the end of the pipe 14 by turning said member 84, fingers 80 separate as shown in FIG. 12 and no longer bear against pipe 76 allowing it to slide free of pipe 14.

Each telescoping end 76 or small pipe 76 has a securing spring 88 therein. Spring 88 may be attached to the inside of pipe 76 by welding, adhesive, etc. if desired. An engaging portion 90 is forced up through aperture 92 in small pipe 76 by spring 88, but may be pushed back into aperture 92 against the force of spring 88. Spring 88 is used to secure small pipe 76 within large pipe 14 by forcing engaging portion 90 into one of a plurality of positioning apertures 94 in pipe 14, thus preventing pipe 76 from pulling free of pipe 76. As such, spring 88 and portion 90 combine with sleeve member 84 to keep telescoping end 76 securely in place inside large pipe 14 while the exercise device 10 is being used.

Telescoping end 76 may be removed from pipe 14 or elongated member 14 by first simply pushing engaging portion 90 back inside aperture 92 below pipe 14, and then sliding telescoping pipe 76 out of pipe 14. Conversely, pipe 76 may be secured to pipe 14 by first pushing portion 90 inside aperture 92 so that pipe 14 may be fit or slid inside pipe 14. Engaging portion 90 is then positioned or slid into place so that spring 88 forces portion 90 into one of the positioning apertures 94, depending on the length of elongated member 14 desired for exercising. Sleeve member 84 is then screwed over fingers 80 helping to secure pipe 76 in place inside pipe 14.

The telescopic isokinetic oscillating exercise apparatus 10 shown in FIGS. 8 through 13 may be reduced in size for storage or carrying purposes by simply sliding the telescoping ends 68 and 76 free of elongated member 14 which significantly reduces the overall length of member 14. Also, ends 68 and 76 may be slid all the way to the middle of elongated member 14 and secured in place, significantly reducing the overall length of member 14. Smaller versions of the exercise apparatus 10 may also be used with telescoping ends 68 and 76 which facilitate carrying such apparatus in luggage, etc.

The oscillating exercise apparatus 10 may be used in numerous other positions or ways other than that shown in FIG. 1. For example, the apparatus 10 may be held overhead and the ends 18 caused to oscillate as shown in FIG. 2. The two positions shown in FIGS. 1 and 2 are only a few of the many different positions in which the apparatus 10 may be used for isokinetic exercising purposes.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

I claim:

1. A method of exercising using an oscillating exercise apparatus comprising the steps of:

providing a flexible elongated member of sufficient flexibility and length to oscillate at a predetermined oscillating range, grasping said flexible elongated member near a middle portion thereof; and moving said flexible elongated member back and forth to cause opposite ends of said flexible elongated member to oscillate at from about three to about seven cycles per seconds resulting in oscillating movement so that said back and forth movement and said oscillating movement are coplanar.

2. The method of exercising of claim 1 wherein said grasping step includes grasping a gripping portion at said middle portion of said flexible elongated member.

3. The method of exercising of claim 1 wherein said elongated member has a length of about 5 feet.

* * * * *